US008480322B2

(12) United States Patent
Wang

(10) Patent No.: US 8,480,322 B2
(45) Date of Patent: Jul. 9, 2013

(54) SIDE KNOCK TYPE MECHANICAL PENCIL

(76) Inventor: Yuanhong Wang, Qingdao (CN)

( * ) Notice: Subject to any disclaimer, the term of this patent is extended or adjusted under 35 U.S.C. 154(b) by 300 days.

(21) Appl. No.: 12/968,458

(22) Filed: Dec. 15, 2010

(65) Prior Publication Data

US 2011/0229245 A1 Sep. 22, 2011

(30) Foreign Application Priority Data

Mar. 17, 2010 (CN) ..... 2010 1 0125731

(51) Int. Cl.
*B43K 21/22* (2006.01)

(52) U.S. Cl.
USPC ..... 401/94; 401/92

(58) Field of Classification Search
USPC ..... 401/92–94, 109
See application file for complete search history.

(56) References Cited

U.S. PATENT DOCUMENTS

| | | | | |
|---|---|---|---|---|
| 3,181,507 | A * | 5/1965 | Dannebaum | 401/99 |
| 3,883,253 | A * | 5/1975 | Naruse et al. | 401/65 |
| 5,702,193 | A | 12/1997 | Kageyama et al. | |
| 6,065,889 | A | 5/2000 | Maruyama et al. | |
| 6,758,617 | B2 * | 7/2004 | Sakaoka | 401/92 |

* cited by examiner

*Primary Examiner* — David Walczak
(74) *Attorney, Agent, or Firm* — Buchanan Ingersoll & Rooney P.C.

(57) ABSTRACT

A side knock type mechanical pencil includes a knock button, a barrel, an intermediate lead tube, and a clip. A fixed hole is formed in the side wall of the front end of the barrel, and a rib groove is formed in the inner front side of the fixed hole. At least one button groove is formed in the front end of the knock button, and at least one protrusion or bump with an inclined plane is formed at the lower side of the rear end of the side button. A shaft is formed by the engagement of the button groove of the front end of the button with the rib groove of the fixed hole. At least one circular bulge which is adapted to engage with the protrusion or bump with the inclined plane is disposed on the side of the intermediate lead tube.

8 Claims, 2 Drawing Sheets

SIDE KNOCK TYPE MECHANICAL PENCIL

BACKGROUND OF THE INVENTION

1. Field of the Invention

This invention relates to the filed of mechanical pencils, especially to a side knock type mechanical pencil.

2. Description of the Related Art

Nowadays, the mechanical pencil can be used continuously by refilling the lead so that it is used frequently by the people when they work and study. The principle of mechanical pencils made in the prior art is to drive the lead to come out by pressing a knock button disposed on a rear end of the pencil.

It is known from the above that when using the mechanical pencil according to the prior art, the user usually has to stop writing, move his/her hand to the rear end of the pencil, and then press the button disposed on the rear end of the pencil so as to make the lead come out. Therefore, the mechanical pencil according to the prior art, has less practicality.

SUMMARY

It is an object of the preset invention to provide the users with a side knock type mechanical pencil so it is convenient for them to press the lead out when using it.

According to one embodiment, the side knock type mechanical pencil comprises a knock button, a barrel, a intermediate lead tube and a clip; wherein a fixed hole is formed in the side wall of the front end of the barrel, and a rib groove is formed in the inner front side of the fixed hole; at least one button groove is formed in the front end of the knock button, and at least one bump with inclined plane is formed at the lower side of the rear end of the knock button; the knock button is embedded in the side wall of the barrel through the fixed hole, a shaft is formed by the engagement of the button groove of the front end of the button with the rib groove of the fixed hole, at least one circular bulge which is adapted to the bump with an inclined plane is disposed on the side of the intermediate lead tube, the intermediate lead tube of the mechanical pencil will move in a reciprocating direction when the circular bulge of the tube is actuated by bump with inclined plane of the button.

Two bumps with an inclined plane are respectively formed in the inner and outer side of lower surface of the knock button, thus a concave region adapted to the body of the intermediate lead tube is formed in the middle of two the bumps, meanwhile, circular bulges which are adapted to the bumps with inclined plane of the knock button are also respectively disposed at the two sides of the lead tube.

Two button grooves are respectively formed in the two sides of the front end of the knock button, thus a concave region adapted to the body of the intermediate lead tube is formed in the middle of two the grooves. The lower ends of the button grooves are in contact with the outer side of the intermediate lead tube.

A groove is formed in the circular bulge of the intermediate lead tube, while a slideway adapted to the groove is configured at the corresponding position of the inner side of the barrel.

Without any pressure on the knock button, the vertical distance between the front-end of the knock button and the barrel is less than the one between the back-end of knock button and the barrel.

The side knock type mechanical pencil also comprises a griping sleeve which covers part of the barrel and is configured with through-hole, the knock button may be inserted into the through-hole.

A positioning bump is disposed on the side of the intermediate lead tube which facing the circular bulge, a positioning groove is formed in the positioning bump, the positioning groove keeps collinear with the groove, and the slideway is configured in the positioning groove.

The purpose of the present invention: just as the side knock type mechanical pencil showed, the front-end button groove of the knock button and the rib groove of fixed hole work together to form a shaft. By pressing the rear end of the knock button, it may keep being rotated about the shaft formed between button groove and rib groove. Then the circular bulge which is pressed by the bump with inclined plane will actuate the intermediate lead tube moving in a reciprocating direction, as a result the lead with the intermediate tube could be pushed out of the barrel.

Embodiments of the present invention will further be described in detail with reference to the drawings.

DETAILED DESCRIPTION OF PREFERRED EMBODIMENTS

Figure 1:
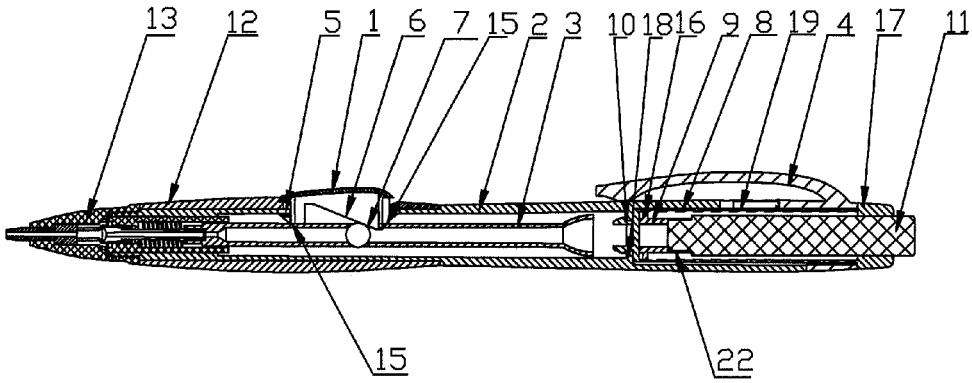
FIG. 1 is a schematic diagram of an embodiment of a side knock type mechanical pencil according to the present invention.
Figure 2:
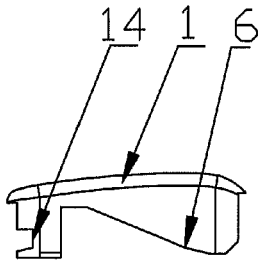
FIG. 2 is a schematic diagram of the knock button shown in FIG. 1.
Figure 3:
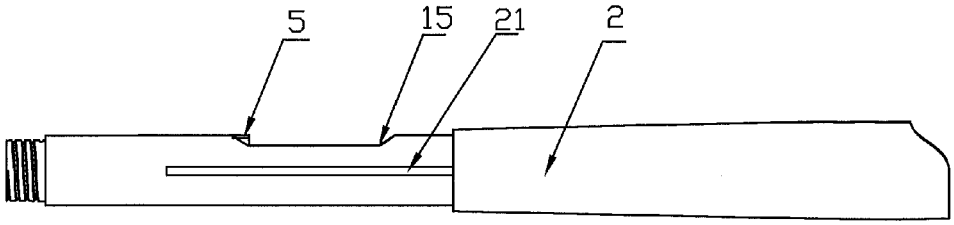
FIG. 3 is a the schematic diagram of the barrel shown in FIG. 1.
Figure 4:
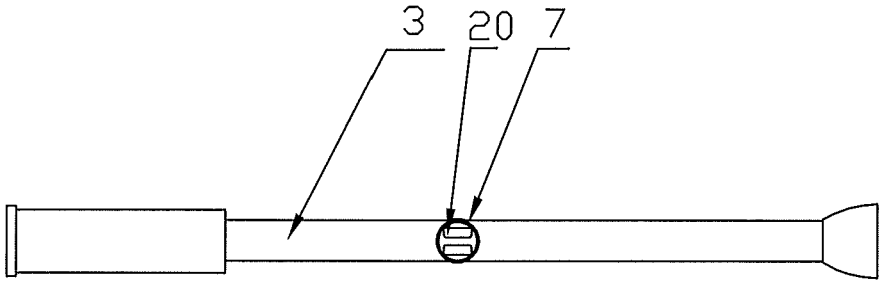
FIG. 4 is a schematic diagram of the intermediate lead tube shown in FIG. 1.

For the purposes of promoting an understanding of the principles, the art and the advantages of the invention, reference will now be made to the embodiments illustrated in the drawings and described in the following written specification. It is obvious that the exemplary embodiments described are part of the embodiments according to the present invention, but not all of them. It is further understood that the present invention includes any alternations and modifications of the illustrated embodiments and includes further applications of the principles of the invention as would normally occur to one skilled in the part to which this invention pertains. Thus, all of these embodiments will come with the scope of the present invention.

As shown in FIGS. 1 to 4, the side knock type mechanical pencil in this embodiment includes a knock button 1, a barrel 2, an intermediate lead tube 3 and a clip 4. A fixed hole 15 is formed in the side wall of the front end of the barrel 2, and a rib groove 5 is formed in the inner front side of the fixed hole 15. At least one button groove 14 is formed in the front end of the knock button 1, and at least one bump with an inclined plane 6 is formed at a lower side of the rear end of the knock button 1. The knock button 1 is embedded in the side wall of the barrel 2 through the fixed hole 15, a shaft is formed by the engagement of the button groove 14 of the front end of the knock button 1 with the rib groove 5 of the fixed hole 15. At least one circular bulge 7 which is adapted to engage with the inclined plane 6 is disposed on the side of the intermediate lead tube 3. The intermediate lead tube 3 of the mechanical pencil will move in a reciprocating direction when the circular bulge 7 of the tube is actuated by the engagement with the inclined plane 6 of the knock button 1.

Specifically, knock button 1 in this embodiment is formed in the fixed hole 15 of the barrel 2 and then configured in the side of barrel 2 through the fixed hole 15. Wherein there is the button groove 14 on the front-end of knock button 1 and the rib groove 5 of the fixed hole 15 is inserted in the button groove 14. Thus the button groove 14 and rib groove 5 work together to form a shaft. The knock button 1 surrounds the shaft to keep running. There sets the circular bulge 7 arranged to engage with the inclined plane 6 on the intermediate lead tube 3. The inclined plane 6 leans against the circular bulge 7. When the user would like to make the lead in the intermediate lead tube 3 extend from the pencil tip 13 on the front-end of barrel 2, he/she presses the knock button 1 to make it pivot about its front-end. The inclined plane 6 of knock button 1 will press the circular bulge 7 and then the intermediate lead tube 3 is driven to reciprocate under the pressure. Thus when the lead in the intermediate lead tube 3 comes out from the pencil tip 13, the user could go on writing. In the process the user is pressing the knock button 1, it's not necessary for them to adjust the position of the side knock type mechanical pencil in the hand. They could directly press the knock button 1 with the thumb or forefinger so as to extend the lead in the intermediate lead tube 3 from the pencil tip 13.

An eraser seat 8 may also be provided on the back-end of barrel 2. A slot 10 is set at the side bottom of eraser seat 8 and a boss 18 is on the inner side of barrel 2. With the function of slot 10 and boss 18, the eraser seat 8 and barrel 2 wedges together to be connected. A spiral groove 19 and revolving handle 17 are respectively set on the inner side and outer side of the eraser seat 8. At the bottom of eraser seat rotating part 9 which is set in the eraser seat 8, a slide block 16 is matched with the spiral groove 19 on the inner side of eraser seat 8. The eraser slot 22 is installed on the outer side of eraser seat rotating part 9. The eraser 11 is on the slide block 16, and it extends from eraser seat 8 by revolving the handle 17.

In this embodiment, the button groove at the front-end of knock button 1 and rib groove of barrel cooperate with each other to form a shaft. Pressing the back-end of the knock button, it could keep turning around the shaft. Herein the knock button with inclined plane presses the circular bulge of intermediate lead tube, which will drive the lead tube to reciprocate and then the lead could be exported from the barrel.

Compared with U.S. Pat. No. 6,065,889A, the relevant knock button is also in the side of barrel, but the intermediate lead tube is driven by the knock button to move for the fact that there is the wedge slide on the knock button and a wedge slide groove in the intermediate lead tube. In the U.S. Pat. No. 6,065,889A, the knock button of the mechanical pencil moves up and down in order to make the intermediate lead tube move. Thus it is easy for the wedge slide and wedge slide groove to get stuck when the former moves up and down. And, compared with U.S. Pat. No. 5,702,193A, the relevant knock button is also in the side of barrel, but the intermediate lead tube is driven by the knock button to move for the fact that there is the wedge slide on the intermediate lead tube. In U.S. Pat. No. 5,702,193A, the back-end of the knock button of the mechanical pencil and the barrel form a shaft while the front-end of the knock button leans against the slope of wedge slide. The knock button drives the wedge slide to move by the front-end of the knock button. However, in U.S. Pat. No. 5,702,193A the user has to give more pressure to move the intermediate lead tube because the wedge slide could be pressed through only one corner of the knock button. In side knock type mechanical pencil of this embodiment, the bump with an inclined plane presses on the circular bulge so that it is easy for the user to smoothly drive the circular bulge of intermediate lead tube to move by the bump with an inclined plane. Therefore, in side knock type mechanical pencil of this embodiment it's more convenient for the user. In U.S. Pat. No. 5,702,193A, only when the key structure must be designed as higher in the front and lower at the back, the extrusion distance could be acquired to make sure the mechanical pencil spit out the lead. Therefore, the front-end of the knock button would be higher than the surface of barrel. The higher part of knock button than the barrel surface is near to the hand of user, which may make the user uncomfortable when using it. Additionally, it also breaks the nice image of the pencil.

Based on the art described above, it is feasible to separately set the bump with inclined plane 6 on the inner and outer sides of the underside of knock button 1. In the middle of the inclined plane 6, a concave region is set to be matched with the intermediate lead tube 3. Meanwhile, the circular bulge 7 corresponding to the bump with an inclined plane 6 of knock button 1 is set respectively on two sides of intermediate lead tube 3.

Specifically, in order to drive the circular bulge 7 to move more smoothly and effectively by the engagement with inclined plane 6, the knock button 1 in this embodiment is set the respective engagement with inclined plane 6 on its two sides. Accordingly, the circular bulge 7 is also set on the two sides of intermediate lead tube 3. Thus the knock button 1 drives the circular bulge 7 on intermediate lead tube 3 to move through two engagements with inclined plane 6, which makes the circular bulge 7 to drive the intermediate lead tube 3 to reciprocate more smoothly.

Furthermore, in order to enable the knock button 1 to move more smoothly around its front-end, the button groove 14 may be separately set on the two sides of front-end of knock button 1. In the middle of button groove 14, the concave region is set to be matched with the intermediate lead tube 3. Then the lower-end of button groove 14 and the outer side of intermediate lead tube 3 could touch each other. Specifically speaking, the button groove 14 is separately set on the front-key of knock button 1 so as to enable knock button 1 firmly keep turning around the shaft which is formed by the mutual cooperation of two press button groove 14 and rib groove 5.

Furthermore, in order to enable the intermediate lead tube 3 to reciprocate smoothly in the barrel 2, a groove 20 may be set on the circular bulge 7 of intermediate lead tube 3 and the slideway 21 matched with the groove 20 on the position corresponding to the inner side of barrel 2. In particular, there is the groove 20 on the circular bulge 7 in this embodiment. Correspondingly, there is the slideway 21 on the inner side of barrel 2. When the intermediate lead tube 3 is inserted in the barrel 2, the slideway 21 will slip into the groove 20. And thereby the intermediate lead tube 3 could reciprocate smoothly in the barrel 2 along the slideway 21.

In this embodiment, the bump with an inclined plane is disposed respectively on the two sides of knock button and the corresponding circular bulge on the two sides of intermediate lead tube, which enables the knock button to accordingly drive the boss on the intermediate lead tube to move through two bumps with inclined plane. Thus the boss could push the intermediate lead tube more smoothly to move back and forth. The separate button grooves disposed on the two sides of front-end of knock button could make the knock button firmly keeping turning around the shaft formed by the mutual cooperation of two button grooves and rib groove. The groove formed on the circular bulge and slideway in the barrel could ensure the intermediate lead tube to reciprocate smoothly in the barrel along the slideway.

On the basis of the art described above, in order to make the image of side knock type mechanical pencil in this embodiment more handsome and ensure the knock button 1 on the side of barrel 2 not to disturb the user's finger on the regular position, the vertical distance between the front-end of knock button 1 and barrel 2 is less than the one between the back-end of knock button 1 and barrel 2.

Specifically, because the vertical distance between front-end of knock button 1 and barrel 2 is less than the one between the back-end of knock button 1 and barrel 2, the end of knock button near to the pencil tip 13 is rather lower. Thus when the user holds the side knock type mechanical pencil in this embodiment, his/her finger only touches rather smaller part of knock button 1 and then he/she would feel more comfortable to use this pencil.

In order to enable the user to use the side knock type mechanical pencil in this embodiment more comfortably, the pencil could also include the gripping sleeve 12 with the through-hole (no indication in the drawing). The gripping sleeve 12 is configured on the barrel 2 while the knock button 1 is inserted into the through-hole. Specifically, the gripping sleeve 12 is set in the barrel 2 and the knock button 1 is inserted into the through-hole. The purpose of gripping sleeve 12 is to let the user hold the pencil in this embodiment more comfortably. Additionally, the knock button extends to the outside of barrel 2 via the through-hole, so the front-end of knock button 1 could be almost smooth as same as the gripping sleeve 12. In this way, it is effective to relieve the user from the inconvenience caused by the convex part of knock button 1. Then the user could be more comfortable when using the side knock type mechanical pencil in this embodiment.

Figure 5:
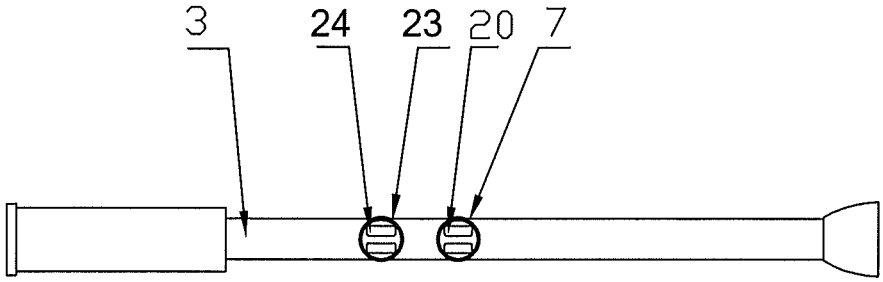
FIG. 5 shows another schematic diagram of the intermediate lead tube of the side knock type mechanical pencil according to another embodiment of the invention.

As shown in FIG. 5, in order to make the intermediate lead tube 3 reciprocate more smoothly in the barrel 2, the positioning bump 23 is also set on the side of intermediate lead tube 3 where the circular bulge 7 is located at. On the positioning bump 23 there is the positioning groove 24 which keeps collinear with the groove 20. The slideway 21 is set to slide in the positioning groove 24. In the specific terms, the concrete structure of positioning bump 23 in this embodiment may be the same as the structure of circular bulge 7. The positioning groove 24 set on the positioning bump 23 may help the slideway 21 to be set to slide in the positioning groove 24 and groove 20 simultaneously. Thus the intermediate lead tube 3 could reciprocate more smoothly in the barrel 2.

In this embodiment, the front-end of knock button is lower than the back-end so that the user could touch the rather smaller part of the knock button. Therefore, it's more comfortable for the user to use the side knock type mechanical pencil in this embodiment. The gripping sleeve is set on the barrel and the knock button is inserted into the through-hole on the griping sleeve, which may cause the user less inconvenience by the convex part of knock button and then make them more comfortable to use this pencil. Because of the positioning bump with the positioning groove on the side the circular bulge is located at, the slideway could be set to slide in the positioning groove and rib groove simultaneously. Thus the intermediate lead tube could reciprocate more smoothly in the barrel.

Finally, it should be noted that, the embodiment should be considered as illustrative for the art of the present invention and not restrictive in character. It should be understood by one skilled in the art that he/she still may make the modifications on the technical scheme of these above embodiments or take the substitution for some technical character of the invention. However all the changes, modifications and alternations do not make the essence of relevant art depart from the spirit and scope of the present invention.

The invention claimed is:

1. A side knock mechanical pencil, comprising a knock button, a barrel, an intermediate lead tube and a clip;

a fixed hole is formed in a side wall of a front end of the barrel, and a rib groove is formed in an inner front side of the fixed hole;

at least one button groove is formed in a front end of the knock button, and at least one region with an inclined plane is formed at a lower side of a rear end of the knock button;

the knock button is embedded in the side wall of the barrel through the fixed hole and the button groove of the front end of the button is engaged with the rib groove of the fixed hole, at least one circular bulge which is adapted to engage with the inclined plane is disposed on a side of the intermediate lead tube such that the intermediate lead tube of the mechanical pencil will move in a reciprocating direction when the circular bulge of the tube is actuated by engagement with the inclined plane of the button.

2. The side knock mechanical pencil according to claim 1, wherein two regions with an inclined plane are respectively formed in the inner and outer side of the lower side of the knock button, thus a concave region adapted to the intermediate lead tube is formed in the middle of the two regions, meanwhile, circular bulges which are adapted to the regions with inclined plane of the knock button are also respectively disposed at the two sides of the intermediate lead tube.

3. The side knock mechanical pencil according to claim 2, wherein two button grooves are respectively formed in the two regions of the front end of the knock button, thus a concave area adapted to the intermediate lead tube is formed in the middle of the two grooves, the lower ends of the button grooves are in contact with the outer side of the intermediate lead tube.

4. The side knock mechanical pencil according to claim 2, wherein a groove is formed in the circular bulge of the intermediate lead tube, while a slideway adapted to the groove is configured at the corresponding position of the inner side of the barrel.

5. The side knock mechanical pencil according to claim 1, wherein without any pressure on the knock button, the vertical distance between the front end of the knock button and the barrel is less than the distance between the rear end of the knock button and the barrel.

6. The side knock mechanical pencil according to claim 1, further comprising a gripping sleeve which covers part of the barrel and is configured with a through-hole, the knock button is inserted into the through-hole.

7. The side knock mechanical pencil according to claim 1, wherein a slideway is formed on an inner side of the barrel, and a positioning groove is formed in the circular bulge, the positioning groove keeps collinear with the slideway.

8. The side knock mechanical pencil according to claim 7, further comprising a positioning bump disposed on the same side of the intermediate lead tube as the circular bulge is disposed, the positioning bump including a second positioning groove that is in alignment with the positioning groove of the circular bulge and is collinear with the slideway.

* * * * *